US011174638B2

(12) United States Patent
Thompson

(10) Patent No.: US 11,174,638 B2
(45) Date of Patent: Nov. 16, 2021

(54) POCKET FORMER AND METHOD FOR REANCHORING LIVE TENDONS

(71) Applicant: Post Tensioning Solutions LLC, Auburn, WA (US)

(72) Inventor: Rick A. Thompson, Kent, WA (US)

(73) Assignee: Post Tensioning Solutions LLC, Auburn, WA (US)

( * ) Notice: Subject to any disclaimer, the term of this patent is extended or adjusted under 35 U.S.C. 154(b) by 0 days.

(21) Appl. No.: 16/444,983

(22) Filed: Jun. 18, 2019

(65) Prior Publication Data

US 2020/0141121 A1 May 7, 2020

Related U.S. Application Data

(60) Provisional application No. 62/754,470, filed on Nov. 1, 2018.

(51) Int. Cl.
*E04C 5/12* (2006.01)
*E04C 5/16* (2006.01)

(52) U.S. Cl.
CPC ..... *E04C 5/12* (2013.01); *E04C 5/163* (2013.01)

(58) Field of Classification Search
CPC ..... B29C 70/541; E04G 21/12; E04G 2021/128; E04C 5/12; E04C 5/122; E04C 5/076; E04C 5/125; E04C 5/163; B28B 7/303; B28B 7/306; B28B 1/14
See application file for complete search history.

(56) References Cited

U.S. PATENT DOCUMENTS 3,907,244 A * 9/1975 Abbott ..... E04G 17/00 249/40
4,410,162 A * 10/1983 Wlodkowski ..... E04C 5/12 249/215
4,773,198 A * 9/1988 Reinhardt ..... E04C 5/122 52/223.13
5,897,102 A * 4/1999 Sorkin ..... E04C 5/12 249/43
7,174,685 B2 * 2/2007 Hayes ..... E04C 5/12 52/223.6
D615,219 S * 5/2010 Sorkin ..... D25/199
8,069,624 B1 * 12/2011 Sorkin ..... E04C 5/12 403/314
8,251,344 B1 * 8/2012 Sorkin ..... E04C 5/122 249/177
D865,505 S * 11/2019 Brewer ..... D8/383
2002/0096619 A1 * 7/2002 Lancelot, III ..... B28B 23/005 249/91

(Continued)

FOREIGN PATENT DOCUMENTS

CA 2164135 C * 6/1997 ..... B25B 7/00
WO WO-2004002701 A2 * 1/2004 ..... E04C 5/16
WO WO-2014032115 A1 * 3/2014 ..... B28B 7/285

*Primary Examiner* — Jessie T Fonseca
(74) *Attorney, Agent, or Firm* — Richard A. Fagin

(57) ABSTRACT

A method for re-tensioning a stressed tendon cast in a reinforced concrete structure includes removing concrete from the structure to expose the tendon. A pocket former is attached to the exposed tendon. The pocket former comprises two partial sections assembled to enclose the tendon. Grout is poured around the pocket former and is allowed to substantially cure. The pocket former is removed and the tendon is cut. An anchor is assembled to the tendon and the tendon is stressed.

3 Claims, 2 Drawing Sheets

(56) References Cited

U.S. PATENT DOCUMENTS

| | | | | |
|---|---|---|---|---|
| 2006/0033003 | A1* | 2/2006 | Watson | E04C 5/12<br>249/177 |
| 2006/0201083 | A1* | 9/2006 | Hayes | E04C 5/12<br>52/223.13 |
| 2017/0016233 | A1* | 1/2017 | Sorkin | E04C 5/122 |
| 2017/0037622 | A1* | 2/2017 | Sorkin | E04C 5/127 |
| 2017/0037623 | A1* | 2/2017 | Sorkin | E04G 21/12 |
| 2017/0204607 | A1* | 7/2017 | Schmidt | E04C 5/122 |
| 2017/0275881 | A1* | 9/2017 | Sorkin | E04C 5/12 |
| 2019/0145103 | A1* | 5/2019 | Brewer | E04C 5/12<br>52/223.13 |

* cited by examiner

POCKET FORMER AND METHOD FOR REANCHORING LIVE TENDONS

CROSS REFERENCE TO RELATED APPLICATIONS

Priority is claimed from U.S. Provisional Application No. 62/754,470 filed on Nov. 1, 2018 and incorporated herein by reference in its entirety.

STATEMENT REGARDING FEDERALLY SPONSORED RESEARCH OR DEVELOPMENT

Not Applicable

NAMES OF THE PARTIES TO A JOINT RESEARCH AGREEMENT

Not Applicable.

BACKGROUND

This disclosure relates to the field of post-tension concrete reinforcing methods and apparatus. More specifically, the disclosure relates to methods and apparatus for affixing anchors to existing tendons in a concrete structure.

Concrete structures having post-tension reinforcement devices, i.e., anchored tendons held in tension, in them may require rework, for example, to insert an opening in the existing structure. In preparation for such rework, it is necessary to re-anchor the existing tendons, that is, to affix new anchors on selected tendons at the edge of the new opening. Using rework methods known in the art, it is required to break and remove concrete proximate the location of the new anchor(s), cut the tendon(s), affix the anchor(s) to the tendons, and pour concrete to form the edge of the opening. The poured concrete is allowed to cure before the cut tendon(s) are tensioned. During the above procedure, from the time the tendon(s) are cut to the time the cut tendon(s) are tensioned again, the concrete structure must be shored, that is, some form of support must be provided to avoid failure of the concrete structure as a result of relaxing the support provided by the tendon(s) that have been cut.

SUMMARY

A method according to one aspect of the present disclosure for re-tensioning a stressed tendon cast in a reinforced concrete structure includes removing concrete from the structure to expose the tendon. A pocket former is attached to the exposed tendon. The pocket former comprises two partial sections assembled to enclose the tendon. Grout is poured around the pocket former and is allowed to substantially cure. The pocket former is removed and the tendon is cut. An anchor is assembled to the tendon and the tendon is stressed.

Some embodiments further comprise removing a part of the concrete structure comprising a cut part of the tendon apart from the anchor.

In some embodiments, the removed part forms an opening in the concrete structure.

A pocket former according to another aspect includes an anchor section including two partial anchor sections. A tendon section include two partial tendon sections, the partial anchor sections and partial tendon sections assemblable into a single structure. The anchor section is shaped to conform produce a pocket in poured concrete enabling affixing and anchor to and tensioning a reinforcing tendon in a preexisting concrete structure having the at least one tendon cast therein.

DETAILED DESCRIPTION

Figure 1:
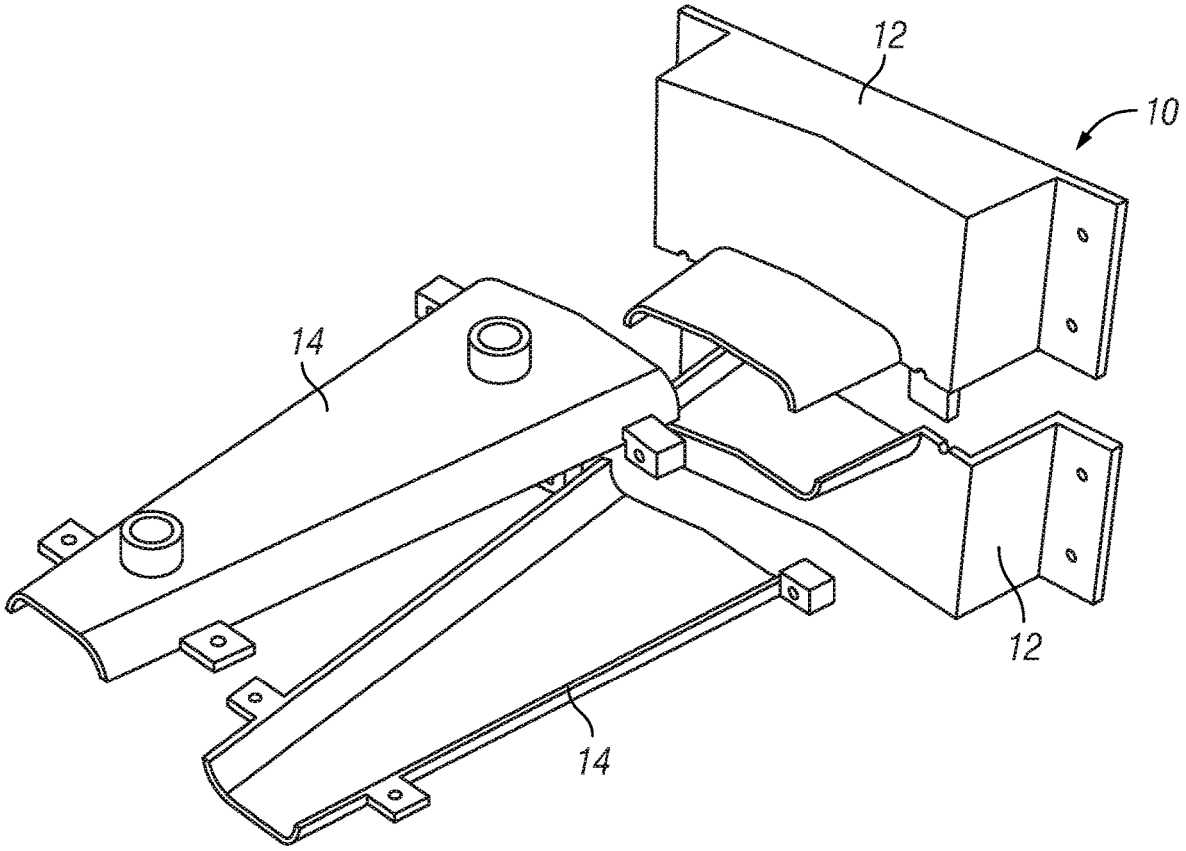
FIG. 1 shows an example embodiment of a concrete block out (pocket former) used to form a pocket for tendons under tension prior to affixing a new anchor.

In a method for reworking a reinforced concrete structure according to the present disclosure, the following actions may be performed. First, based on where part of the concrete structure is to be reworked, such as to make an opening, the tendons that will require re-anchoring should be located within the concrete structure with respect to position and depth. The location of such tendons may be used to determine the best places to chip out the concrete in the concrete structure to expose the tendons.

Once the places to chip out the concrete are determined, at each such location, cut a hole large enough to allow the pocket former to be installed around the stressed or "live" tendons may be created by chipping out the concrete of the concrete structure.

The pocket former is installed around the live tendons to be re-anchored. A form board may be installed around the pocket former(s) to prepare for pour back with grout. Grout may then be poured into the hole having the form board in place and pocket former around the tendon(s) to be re-anchored. The pocket former and form board in combination provide that the shape of the grout after cure will provide a load bearing surface for one or more post-tension anchors.

The grout may be allowed to cure to full compressive strength after pouring. The same procedure may be performed at all tendon locations to be re-anchored prior to cutting any such tendons and re-stressing. It is important to ensure that the curing of the grout is substantially complete while the tendons are still live, that is, prior to cutting for re-anchoring. This make it possible to cut only one tendon or one group of tendons and then re-stress it before repeating the procedure on subsequent tendons or groups of tendons. This enables keeping as many tendons as possible under load so as to avoid the need to re-shore the concrete structure for de-tensioning and re-stressing.

Once the grout is substantially fully cured, the pocket former may be removed and the tendon(s) cut. New strand anchors may be installed over the tendon(s) in the blockout(s) formed by the pocket former. The blockout(s) are shaped so that the anchor(s) will fit within the respective blockout(s) with their load transfer surface(s) in contact with the edge of the grout and with suitable features formed in the grout to enable tensioning the tendon(s). The tendon(s) may then be tensioned to the desired force and allowed to seat in the respective anchor(s).

The foregoing procedure may be repeated for each tendon and/or group of tendons. Once all tendons have been cut and re-stressed, it is then possible to cut the opening or the concrete section to be removed without the need to perform any action on tendons present in such section because any such tendons have been decoupled from the reinforcing system.

A Clam Shell Blockout according to one embodiment may be in the form of a four-piece pocket former mold that can be placed around one or more live tendons. This makes possible for the live tendons to be cut and re-stressed after pouring the grout. A method for performing such cutting and restressing will be explained in more detail below.

FIG. 1 shows an example embodiment of a pocket former according to the present disclosure. The pocket former 10 may comprise an anchor section comprised of two partial (e.g., half) sections 12 and a tendon section comprised of two partial sections 14. The partial sections 12, 14 may be assembled around one or more exposed, live tendons in a chipped out section of concrete structure as explained above. The anchor section will produce a pocket in the grout in which one or more anchors (FIG. 2) may be inserted for re-stressing (re-tensioning) the one or more tendons as explained above. The tendon section will produce a pocket in the grout so as to enable the tendon(s) to be accessed for affixing the anchor and re-stressing after the grout is cured.

Figure 2:
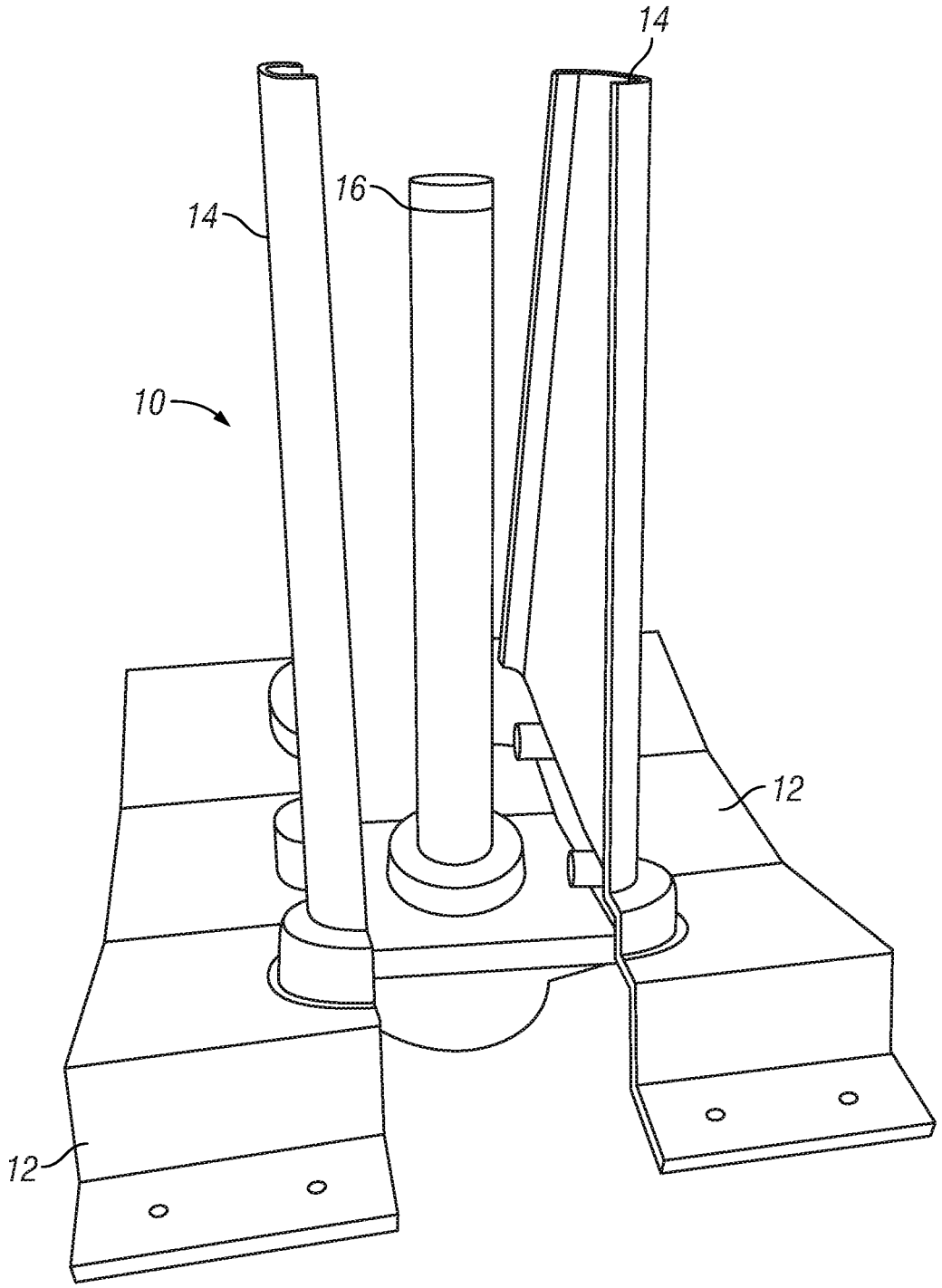
FIG. 2 shows the pocket former of FIG. 1 surrounding an encapsulated anchor.

FIG. 2 shows the pocket former 10 split and disposed about an encapsulated anchor 16 to provide better understanding of how the pocket former 10 is used. The anchor 16 may be any type used in post-tension concrete reinforcement. As a non-limiting example, an encapsulated anchor such as disclosed in U.S. Pat. No. 7,275,347 issued to Hayes.

Various embodiments of a pocket former may comprise shapes enabling placement of one or more anchors proximate each other to re-anchor a single tendon or a plurality of tendons depending on the structure of the reinforcing system used in any concrete structure.

Using a pocket former and method according to the present disclosure, it may be possible to avoid re-shoring that is often a time consuming and expensive part of cutting out and removing post-tensioned concrete slabs.

Although only a few examples have been described in detail above, those skilled in the art will readily appreciate that many modifications are possible in the examples. Accordingly, all such modifications are intended to be included within the scope of this disclosure as defined in the following claims.

What is claimed is:

1. A method for re-tensioning a stressed tendon cast in a reinforced concrete structure, comprising:

removing set concrete from the structure to expose a stressed part of the tendon, the tendon being stressed to reinforce the structure prior to the removing set concrete;

attaching a pocket former to the exposed stressed part of the tendon, the pocket former comprising two partial sections assembled to enclose the stressed part of the tendon without cutting the stressed part of the tendon;

pouring grout around the pocket former;

allowing the grout to substantially cure;

removing the pocket former;

cutting the stressed part of the tendon;

assembling an anchor to the cut part of the tendon; and stressing the cut part of the tendon.

2. The method of claim 1 further comprising removing a further part of the reinforced concrete structure, wherein the further removed part comprises the stressed, cut part of the tendon.

3. The method of claim 2 wherein removing the removed part forms an opening in the concrete structure.

* * * * *